United States Patent [19]

Cochran et al.

[11] 3,995,857

[45] Dec. 7, 1976

[54] GOLF CLUB HEAD

[75] Inventors: Alastair J. Cochran, Sutton Coldfield, England; John W. Jepson, Marion, Mass.; Edward R. Woolley, Rancho Santa Fe, Calif.; Francis deS. Lynch, Mattapoisett, Mass.

[73] Assignee: Acushnet Company, New Bedford, Mass.

[22] Filed: Feb. 11, 1976

[21] Appl. No.: 657,023

Related U.S. Application Data

[60] Division of Ser. No. 381,050, July 20, 1973, Pat. No. 3,955,820, which is a continuation-in-part of Ser. No. 311,821, Dec. 4, 1972, abandoned, which is a continuation-in-part of Ser. No. 146,255, May 24, 1971, abandoned, and Ser. No. 106,690, Jan. 15, 1971, abandoned.

[52] U.S. Cl. ..... 273/77 A; 273/164

[51] Int. Cl.[2] ..... A63B 53/04

[58] Field of Search ..... 273/77 R, 77 A, 80 C, 273/80.2, 167–175, 164

[56] References Cited

UNITED STATES PATENTS

| | | | |
|---|---|---|---|
| 1,133,129 | 3/1915 | Govan | 273/171 |
| 1,139,985 | 5/1915 | Legh | 273/167 F X |
| 1,516,786 | 11/1924 | Prentiss | 273/77 A |
| 1,642,462 | 9/1927 | Reach | 273/77 A |
| 1,666,174 | 4/1928 | Holland | 273/169 X |
| 1,671,956 | 5/1928 | Sime | 273/167 F X |
| 1,840,924 | 1/1932 | Tucker | 273/271 |
| 1,901,562 | 3/1933 | Main | 273/169 |
| 1,917,774 | 7/1933 | Ogg et al. | 273/167 F |
| 1,927,083 | 9/1933 | Davis | 273/77 A X |
| 2,231,847 | 2/1941 | Dickson et al. | 273/167 F X |
| 2,332,342 | 10/1943 | Reach | 273/174 X |
| 2,846,228 | 8/1958 | Reach | 273/169 |
| 3,212,783 | 10/1965 | Bradley et al. | 273/171 |
| 3,305,235 | 2/1967 | Williams | 273/167 F |
| 3,473,370 | 10/1969 | Marciniak | 273/77 A |
| 3,516,674 | 6/1970 | Scarborough | 273/169 |
| 3,655,188 | 4/1972 | Solheim | 273/169 X |
| D179,816 | 3/1957 | Penna | 273/167 D X |

FOREIGN PATENTS OR APPLICATIONS

| | | | |
|---|---|---|---|
| 196,133 | 4/1923 | United Kingdom | 273/169 |
| 371,974 | 5/1932 | United Kingdom | 273/167 F |
| 440,379 | 12/1935 | United Kingdom | 273/171 |
| 439,187 | 12/1935 | United Kingdom | 273/171 |

*Primary Examiner*—Richard J. Apley
*Attorney, Agent, or Firm*—Eyre, Mann, Lucas & Just

[57] ABSTRACT

A golf club head having a high radius of gyration while maintaining desirable conventional design features is disclosed. The golf club head comprises a steel head and preferably tungsten embedded inserts being added in the heel and toe areas thereof. The entire back of the club head is located on one side of an area defined by a plane which is parallel to the axis of the golf club shaft and tangential to the top of the back of the club head.

18 Claims, 6 Drawing Figures

GOLF CLUB HEAD

This application is a division of application Ser. No. 381,050 filed July 20, 1973 and now U.S. Pat. No. 3,955,820 issued May 11, 1976, which in turn was a continuation-in-part of application Ser. No. 311,821 filed Dec. 4, 1972 and now abandoned which in turn was a continuation-in-part of application Ser. No. 146,255 filed May 24, 1971 and now abandoned and application Ser. No. 106,690 filed Jan. 15, 1971 and now abandoned.

The present invention relates to a golf club "iron" with a club head made of steel and having a relatively high radius of gyration about an axis passing through the center of gravity of the club head and parallel to the club head shaft, said high radius of gyration being provided by dense material included within the confines of the club head preferably at the heel and toe areas thereof.

It has previously been suggested that maximizing the moment of inertia about an axis passing through the centroid of the club head and being perpendicular to the sole of the club head will provide a club with reduced hooking and slicing characteristics. In accordance with the present invention, the applicants have devised a new and useful structure which will not only reduce the hooking and slicing attendant with the game of golf but will also maintain conventional club head characteristics including appearance, "feel," balance and the like and will satisfy United States Golf Association Rules of Golf.

In accordance with the present invention, the golf club head is made of steel as opposed to lighter metals which tend to destroy feel. At least one concentrated weight is embedded in the back of the head whereby a relatively high radius of gyration is imparted to the golf club head. Preferably, the steel club head is made with embedded concentrated weights in both the heel and toe areas with a hollowed out back and with the entire back of the club head forward of a line located on one side of an area defined by a plane which is parallel to the axis of the golf club shaft and tangential to the top of the back of the club head.

In all cases, club heads according to the present invention have a radius of gyration above about 1.05 inches and preferably above 1.10 inches about an axis which is parallel to the shaft and which passes through the centroid (center of mass) of the club head. A suitable method for measuring this radius of gyration is based on the standard torsional pendulum test for measuring moment of inertia. The radius of gyration can be defined by the following formula:

$$K = \sqrt{I/M}$$

wherein $K$ is the radius of gyration about an axis which passes through the centroid of the club head and is parallel to the axis of the golf club shaft, $I$ is the moment of inertia of the club head about the same axis and $M$ is the mass of the club head. The club head is defined as the weight of a golf club below a point located about 5 inches up the golf club shaft from the heel. In determining the moment of inertia of the club head, the centroid of the club head is first located in known manner. A point is then selected along an axis which passes through the centroid of the club head and is parallel to the axis of the golf club shaft. The club head is suspended from this point by one or more wires or other suitable means which maintain the club head in proper position for measuring its radius of gyration about an axis parallel to the axis of the shaft and which passes through the centroid of the club head. The moment of inertia of the club head is then determined in known manner with respect to the axis which passes through the centroid. When the moment of inertia is thus determined and the mass of the club head is determined, the radius of gyration can be computed according to the formula given hereinabove.

Best results are achieved when the improvements of the present invention are embodied in a correlated plurality or set of clubs which in general comprise a selected set of irons such as a complete set of the 2 through 10 irons or a beginner's set of irons such as the 3, 5, 7, and 9 irons or any other selected combination of three or more irons. The radius of gyration of the club head for each of the selected irons in a correlated set is within the ranges as set out in Table I below:

TABLE I

| IRON | MINIMUM RADIUS OF GYRATION (inches) | MAXIMUM RADIUS OF GYRATION (inches) |
|---|---|---|
| 2 | 1.06 | 1.17 |
| 3 | 1.07 | 1.18 |
| 4 | 1.08 | 1.19 |
| 5 | 1.09 | 1.20 |
| 6 | 1.10 | 1.21 |
| 7 | 1.11 | 1.22 |
| 8 | 1.12 | 1.23 |
| 9 | 1.13 | 1.24 |
| 10 (pitching wedge) | 1.14 | 1.25 |

The radius of gyration for each club in increasing numerical order is preferably higher than the radius of gyration of the previous club in the set. It will be understood that it is not necessary to include all of the clubs in the set and that advantage is obtained in a set when at least any three of the clubs including at least one of the 2, 3, and 4 irons have the radius of gyration as set out above.

The weight of the club head will generally be the same as conventional club heads. This will generally be from about 4 to about 12 ounces for the 2 iron and from about 6 to about 16 ounces for the 9 iron and best results are obtained with a club head weight of from about 7 to about 9 ounces for a 2 iron and from about 9 to about 11 ounces for the 9 iron with the rest of the clubs having a weight therebetween, the weight of each successive club head increasing in numerical order from the 2 iron to the 9 iron.

It is pointed out that in the present invention the weight distribution is determined by the radius of gyration and not solely by the moment of inertia. While it has been suggested in the prior art that the moment of inertia of a club head should be increased in order to reduce hooking and slicing, the mere addition of weights to the club head has never been practical since merely increasing the moment of inertia of the club head by adding weight tends to make the club head too heavy and virtually unplayable. In contrast to this, the applicants have discovered that when the radius of gyration is increased in accordance with the teaching of the present invention, these problems are not encountered and conventional characteristics such as desirable swing weight can be obtained for the correlated set of clubs even where the club heads are made of steel. It should additionally be noted that the applicants are concerned with the radius of gyration about an axis which is parallel to the shaft as opposed to prior art patents which are concerned with an axis perpendicular to the sole. The applicants have discovered that it is the axis parallel to the shaft which gives the best results since this is the axis about which all of the action of a club head takes place.

When the radius of gyration is maintained within the limits as set out in this specification, many desirable results are obtained. There is less of a tendency for hooking and slicing the ball when the ball hits the club face other than on the center of gravity. Furthermore, there is less loss of distance with a ball hit away from the center of gravity. And, most importantly, these and other advantageous results can be obtained in accordance with the present invention with club heads which have conventional appearance, good feel, and conventional swing weights.

These and other advantages of the present invention may be more fully understood with reference to the accompanying drawings in which like numbers are used for like parts and wherein.

Figure 1:
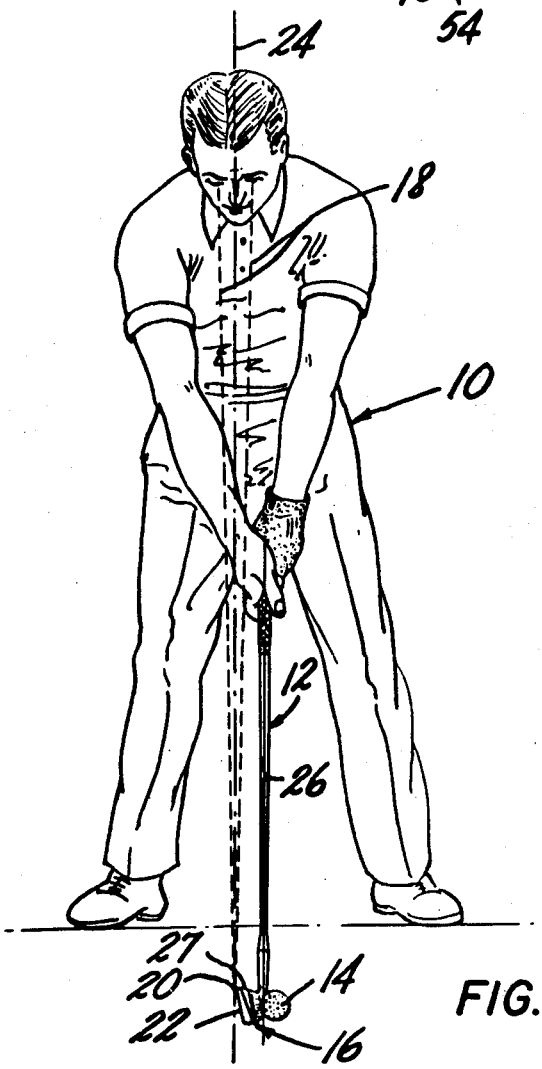
FIG. 1 shows a golf club made in accordance with the present invention in use by a golfer.

In FIG. 1 there is shown a golfer 10 holding a golf club 12 in standard position for striking a golf ball 14. The golf club 12 has the preferred embodiment of a club head 16 made in accordance with the present invention. The line of sight 18 of the golfer 10 sees the back of the top of the club head 20 but does not see any portion of the back of the club head 22. The reason for this is that the entire back 22 of the club head 16 is on one side of a plane 24 which is parallel to the axis of the club shaft 26 and is tangential to the back of the top of the club head 20. Since there are no protrusions on the back of the club head that project out beyond plane 24, the golfer's eye is not distracted when addressing the ball in standard position. For the purposes of the present invention, the back of the club head is defined as that part of the back of the club head which is below the top 27 of the club head.

Figure 2:
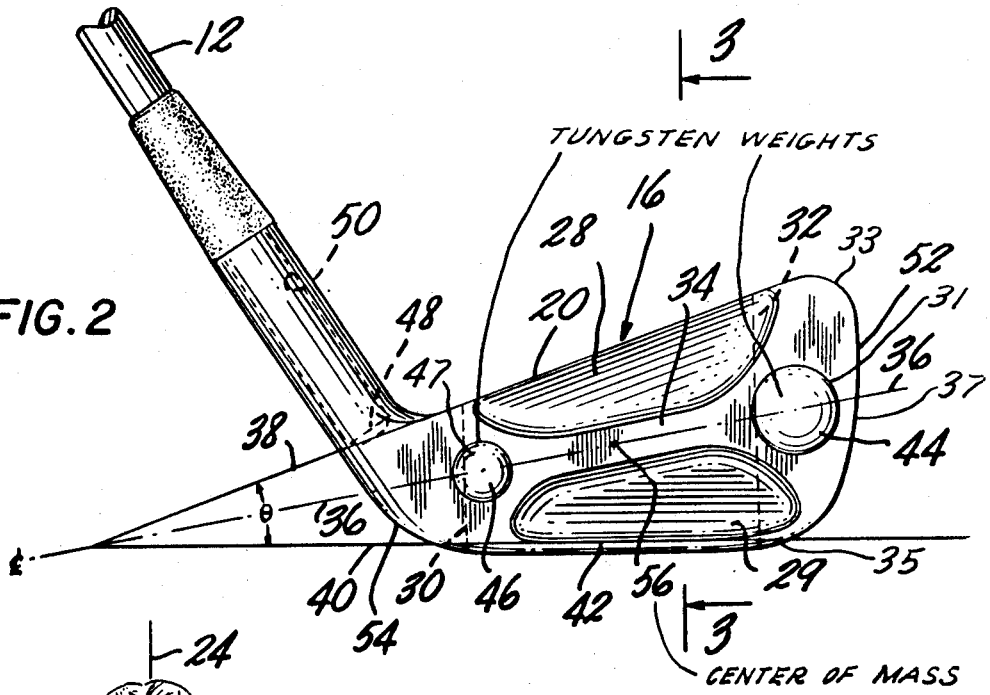
FIG. 2 shows the back of a club head made in accordance with the present invention.

FIG. 2 shows one way of making the back of a golf club head with the weight distributed according to the present invention. The club head is made of steel in order to maintain good feel and conventional appearance. The steel may be stainless steel, chrome plated steel, etc., and the club head may be formed by machining, investment casting or the like. The preferred form of structure illustrates one way in which the weight distribution according to the present invention is achieved by hollowing out or cutting away at least one portion of the back of the iron behind the scored area of the club face whereby the surface of the back of the club comprises one or more indentations in the center area thereof as opposed to the protrusions in the central area in conventional irons. For best results, there is provided an upper hollowed out area 28 and a lower hollowed out area 29 which comprise a substantial portion of the back of the club head within the area delineated by the edges of the scored area 30 and 32. The top of the back of the club head 20 to which plane 24 of FIG. 1 is tangential may be defined by the line along the top of the club head extending from line 30 to line 32. One or more reinforcing ribs 34 are preferably located in the hollowed out areas 28 and 29 in order to reinforce the club head and provide proper balance of the hollowed out areas. In a preferred embodiment of the invention, and as shown, the center line 36 of the rib 34 essentially bisects the angle $\theta$ made by a line 38 passing through the back of the top of the club 20 and a line 40 passing through the back of the bottom of the lower hollowed out area 29. When the center of the rib is located along this line, it is highly advantageous since this is the area in which most golf balls are struck and thus the reinforcing rib reinforces the golf club head at the place where greatest stress is put upon it. With the rib located in this area, the club also has the advantage of a solid feel and proper balance when the ball is hit. While this is the preferred location for the reinforcing rib, it is to be understood that the reinforcing rib could be in an X shape in which case there could be four hollowed out areas or in any other desired shape or there could be no rib at all. The only requirement is that the club head be strong enough to preserve its structural integrity under normal playing conditions.

Weights 44 and 46 are shown inserted into sockets 31 and 47 which are in the steel in the back of the toe and the heel of the club head respectively. These weights are made of a material which has a density of at least 16 grams per cubic centimeter and are thus considerably more dense than the steel of which the club head 16 is made. Suitable weighting materials include tungsten, depleted uranium and other known materials having the specified density.

Figure 6:
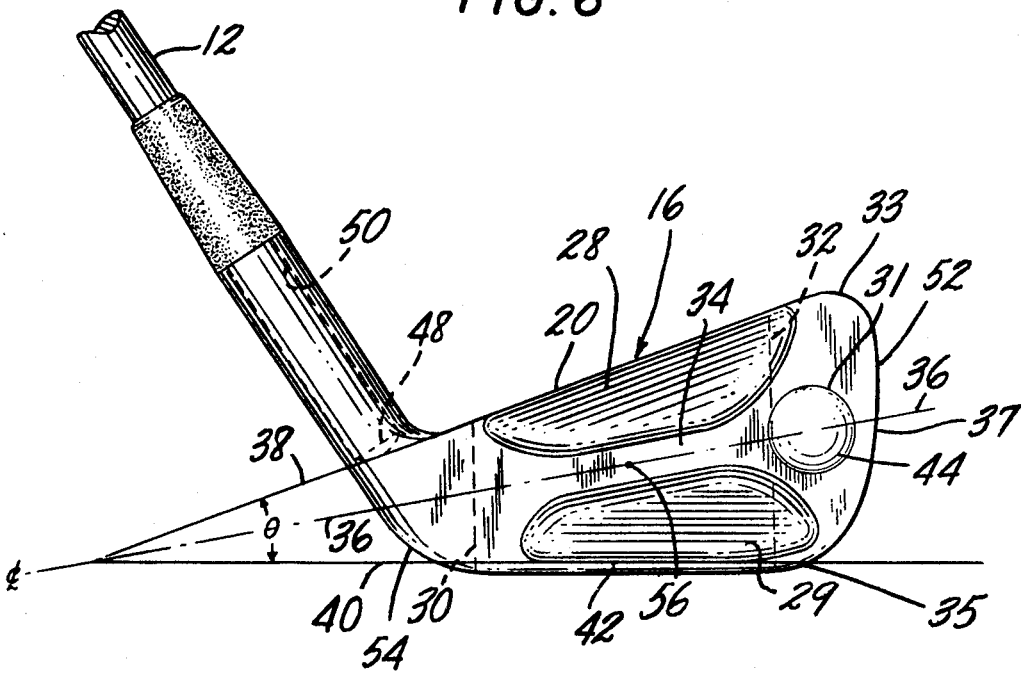
FIG. 6 shows the back of a club head made in accordance with the present invention and having only a toe weight.

It has been found that it is necessary for there to be added weight in the toe (see FIG. 6) in order to give the club the best feel and handling characteristics. In the preferred form of structure shown, the closest point of the socket 31 for the added weight 44 is at least 1/16 inch from the top periphery 33 of the toe and should also be at least 1/16 inch from the sole periphery 35 of the toe. In addition, the closest point of the socket 31 for the added weight 44 should be at least 1/32 inch but not more than ¾ inch away from the outer periphery 37 of the toe. For best results, the distance from the top and sole peripheries should be at least ⅛ inch, the distance from the outer periphery should be at least 1/16 inch and the maximum distance from the outer periphery should be no more than ½ inch. Furthermore, the closest point of the socket 31 is preferably spaced in longitudinal direction from the center 56 of the club head, and for best results this distance should be at least ½ inch. It will be apparent to those skilled in the art that more than a single toe weight could be used, if desired, to achieve the same result. However, even where a plurality of toe weights are used, the distances set out hereinbefore should still be followed.

It is also preferable to have a heel weight 46. While the heel weight is shown on the back of the club head in socket 47, it is to be understood that this heel weight can be located in the bottom 48 of the hosel shaft receiving hole 50.

The center of mass of the club head is preferably located at a point 56 which is approximately equidistant between lines 30 and 32. In order to locate the center of mass at this point, and still maintain the other desirable features of the present invention, the mass of the weight 44 located in the toe area of each club in the set should be at least two times as great as the mass of the weight 46 added in the heel area and preferably three times as great. It has further been found that for best results the center of the weights should be located along line 36 since, as previously mentioned, this is the line along which most shots are hit.

The weights 44 and 46 are preferably made of tungsten alloys and for best results the tungsten alloyed weights should contain between about 85 and 95% tungsten. If the percentage of tungsten is greater than about 95%, the weights become brittle and are not easily fabricated. On the other hand, if the percentage of tungsten is less than about 85%, then there is significantly less advantage since the mass of the tungsten alloy will not be sufficiently greater than the steel club head. Because of the high density of the added material according to the present invention, sufficient dense material can be embedded in the heel and toe areas of the club head so that it is not necessary to provide a hollowed out area on the back of the club but yet it is still possible to achieve a club having the radius of gyration of the present invention and having the entire back of the club head forward of the golfer's line of sight.

The added weight is useful not only for achieving the desired radius of gyration of the club head but can also be used to achieve the desired swing weight. As is well known in the art, the swing weight of a golf club is the moment of the club weight about a point 12 inches from the end of the club at the grip end. The method of determining swing weight is found, for example, in The Search For The Perfect Swing, J. B. Lippincott Co., Philadelphia and New York, 1968, especially pages 214–216, by Alastair J. Cochran and John Stobbs. This swing weight system basically comprises a measurement of the club weight, determining where its center of gravity is, measuring the distance between the center of gravity and a point 12 inches from the end of the club at the grip end and then multiplying this distance by the total weight of the club to obtain a moment of inertia figure. It is common practice to perform this measurement on a swing weight machine specially designed to make this measurement. This swing weight machine is commonly available throughout the country and is sold under the trademark Lorythmic. It has a scale with letter designations corresponding to the moment result and this scale, as is well known, commonly runs from C0 to E5. Most manufacturers who adjust swing weight do so by adding or removing weight from the club head. In accordance with the present invention this may be accomplished by varying the size of the added weight (44 and 46 in FIG. 2). Swing weights are relatively minor graduations and therefore adjustment of the added weights 44 and 46 to obtain the desired swing weight will not substantially affect the radius of gyration of the club head.

Figure 3:
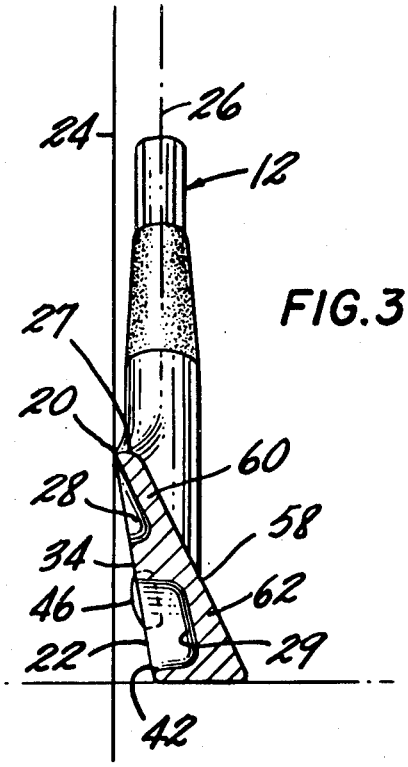
FIG. 3 shows a sectional view of FIG. 2 taken through line 3—3.

In FIG. 3 is shown a sectional view of FIG. 2 taken through line 3—3. As there shown, rib 34 extends through followed out areas 28 and 29 essentially in the middle of the club head face 58. Plane 24 is shown tangential to the top of the back of the club head 20 and parallel to the axis of the shaft 26. The thickness of the club head face at points 60 and 62 is preferably at least about 0.15 inches since otherwise there may be an undesirable "pinging" sound when the club makes contact with the ball. The weights are preferably embedded in the back of the club and positioned as close to the striking surface as possible. In this way the weight is concentrated behind the shot and gives excellent feel to the club as well as maintaining conventional appearance.

Figure 4:
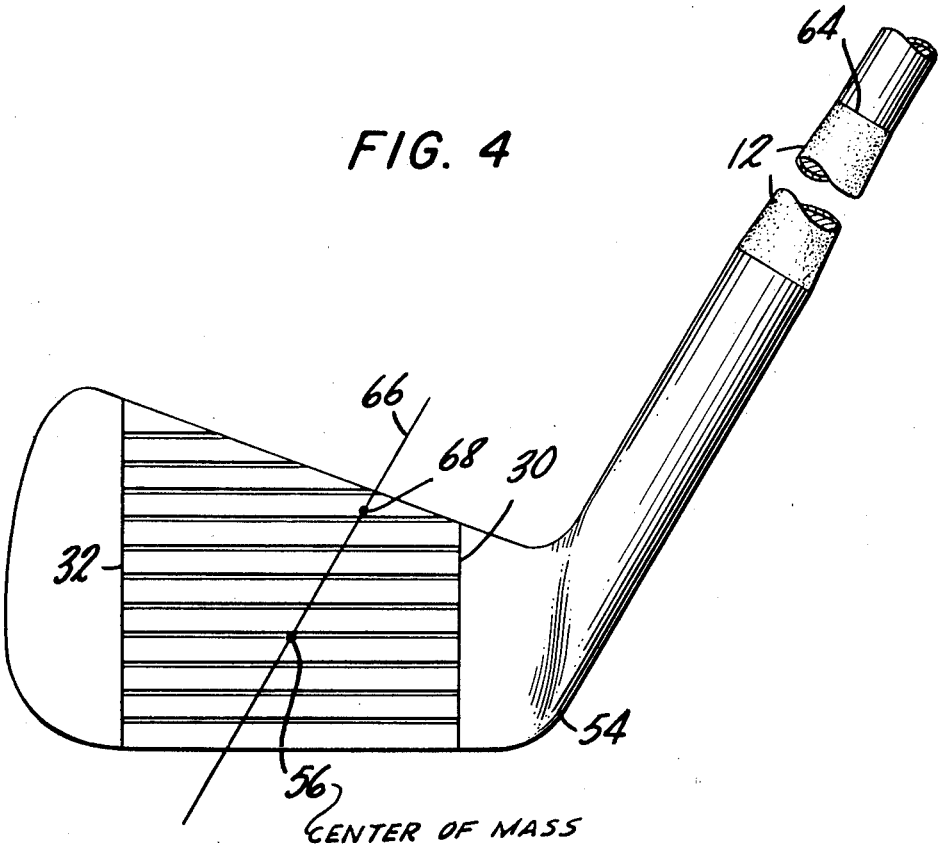
FIG. 4 shows the method of determining the radius of gyration.
Figure 5:
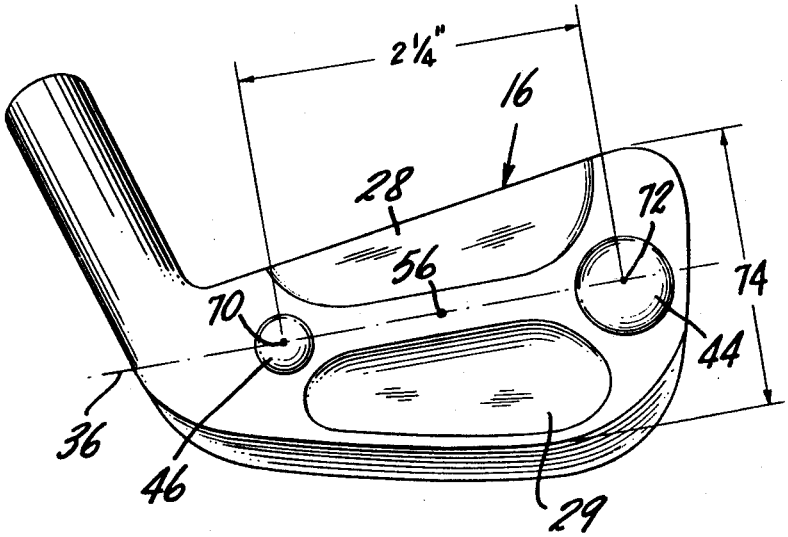
FIG. 5 shows a suitable placement of the weights in accordance with the present invention.

In FIG. 4 shows the way in which the radius of gyration of the club head may be calculated in accordance with the present invention. By the term club head it is intended to mean the weight of a golf club which is below a point 64. The point 64 is located about 5 inches up the golf club shaft 12 from the heel 54. It will thus be understood that the term club head may encompass a hosel which is separate from the rest of the club head and may also encompass a heavy shaft below point 64 or any separate weight added in the shaft below point 64. According to the present invention, the correct weight distribution of the club head as hereinabove defined is determined by the radius of gyration of the club head about the axis 66. The axis 66 is parallel to the shaft 12 and it passes through the centroid 56 of the club head as set forth above. As previously mentioned, the radius of gyration can be defined by the following formula:

$$K = \sqrt{I/M}$$

wherein $K$ is the radius of gyration about a specific axis, $I$ is the moment of inertia of the club head about the same axis and $M$ is the mass of the club head. In determining the moment of inertia of the club head, the centroid 56 of the club head is first located in known manner. For purposes of the present invention, the centroid of the club head is defined as the center of mass of the club head and in FIG. 5 is shown at point 56. A point 68 is then selected along the axis 66 which is preferably within the area of the club head and above the centroid 56. Point 68 may be located anywhere on line 66 but is preferably above the point of the centroid. When point 68 has thus been selected, the club head is suspended at point 68 by one or more wires or other suitable means which maintain the club head parallel to shaft 12. The moment of inertia of the club head is then determined in known manner with respect to the axis 66. When the moment of inertia is thus determined and the mass of the club head is determined, the radius of gyration can be computed according to the formula given hereinabove. If the radius of gyration is not in accordance with the present invention, then weight is added or redistributed in the general areas of the toe and the heel and hosel of the club head until the desired radius of gyration is achieved. This redistribution of weight to the club head to achieve the desired radius of gyration is well within the skill of the art and can suitably be accomplished by means of added tungsten weights. When the weight is so distributed that the radius of gyration is within the present invention, the club head can be fashioned in any suitable design which the maker considers commercially acceptable.

In FIG. 5 there is shown a scale model of the golf club head of a number 3 iron. Hollows 28 and 29 are provided in the back of the club head of a depth corresponding to the depths of the hollows in FIG. 3. Tungsten weights 44 and 46 with their centers along line 36 are embedded in the back of the club head 16. The distance between the center 70 of the weight 46 and the center 72 of the weight 44 is suitably 2¼ inches.

The centers 70 and 72 of the weights are equally spaced along line 36 from the center of gravity 56 of the club head.

It will be understood that other clubs in the set from the 2 through the 10 can be made in the same manner as shown in FIG. 5 for the 3 iron. Generally, the height of the toe, i.e., distance 74, will increase as the number of the iron increases. Thus the 2 iron will have the smallest distance 74 and the 10 iron will have the largest distance. The distance 74 for the 3 iron shown is suitably 1⅞ inches. For a 7 iron a suitable distance 74 is 2 inches and other irons will have a distance 74 in proper proportion as is well known in the art.

In Table I there was given a range of minimum and maximum radii of gyration for each of the various club heads. When the club heads have the appearance of FIG. 5 and the club has a D2 swing weight, the added weight can be 90% tungsten alloy weights and suitable weight values are shown in Tables II and III. Tables II and III also show suitable club head weights, moments of inertia, in addition to heel and toe weight values and radii of gyration in accordance with the present invention. It is to be understood that these tables are only examples and are not intended to limit the invention. The preferred embodiment of the present invention is where the radius of gyration is at a maximum as shown in Table III.

In each case, the weights were positioned in accordance with FIG. 5. More specifically, the centers of the weights were located along line 36 of FIG. 5, the centers of the weights were spaced 2¼ inches from each other and the centers of the weights were equally spaced from the center of gravity 56. The center of gravity in the tables is for the finished club head including the added tungsten weights.

TABLE II

| IRON NO | D2 (oz) Typical Wt. (finished, not attached to shaft) | k Min. (in.) | I (in² oz) | Toe Wt. (oz) | Heel Wt. (oz) |
|---|---|---|---|---|---|
| 2 | 8.44 | 1.06 | 9.48 | .65 | .25 |
| 3 | 8.68 | 1.07 | 9.94 | .65 | .25 |
| 4 | 8.96 | 1.08 | 10.45 | .65 | .25 |
| 5 | 9.22 | 1.09 | 10.05 | .65 | .25 |
| 6 | 9.41 | 1.10 | 11.39 | .65 | .25 |
| 7 | 9.58 | 1.11 | 11.80 | .65 | .25 |
| 8 | 9.87 | 1.12 | 12.38 | .65 | .25 |
| 9 | 10.14 | 1.13 | 12.95 | .65 | .25 |
| 10 | 10.29 | 1.14 | 13.37 | .65 | .25 |

TABLE III

| IRON NO | D2 (oz) Typical Wt. (finished, not attached to shaft) | k Max. (in) | I (in² oz) | Toe Wt. | Heel Wt. |
|---|---|---|---|---|---|
| 2 | 8.44 | 1.17 | 11.55 | .90 | .25 |
| 3 | 8.68 | 1.18 | 12.09 | .90 | .25 |
| 4 | 8.96 | 1.19 | 12.69 | .90 | .25 |
| 5 | 9.22 | 1.20 | 13.28 | .90 | .25 |
| 6 | 9.41 | 1.21 | 13.78 | .90 | .25 |
| 7 | 9.58 | 1.22 | 14.26 | .90 | .25 |
| 8 | 9.87 | 1.23 | 14.93 | .90 | .25 |
| 9 | 10.14 | 1.24 | 15.59 | .90 | .25 |
| 10 | 10.29 | 1.25 | 16.08 | .90 | .25 |

It will be understood that the claims are intended to cover all changes and modifications of the preferred embodiment of the invention, herein chosen for the purpose of illustration, which do not constitute departures from the spirit and scope of the invention.

What is claimed is:

1. A correlated set of golf club irons comprising at least three irons at least one of which is selected from the group consisting of the 2, 3, and 4 irons, each of which comprises a shaft and a steel club head, the steel club head of at least three of the irons having heel and toe portions, weighting means for said club head, said weighting means including added weight in the back of the club head in at least the toe area of the club head of at least 16 grams per cubic centimeter, and said weighting means further including at least one indentation in the back of the club head between the heel and toe portions, the mass and position of the added weight and the size and position of the indentation being sufficient in combination to provide the club head with a radius of gyration about an axis which is parallel to the axis of the shaft and which passes through the centroid of the club head within about the following limits for the at least three irons:

| IRON | MINIMUM RADIUS OF GYRATION (Inches) | MAXIMUM RADIUS OF GYRATION (Inches) |
|---|---|---|
| 2 | 1.06 | 1.17 |
| 3 | 1.07 | 1.18 |
| 4 | 1.08 | 1.19 |
| 5 | 1.09 | 1.20 |
| 6 | 1.10 | 1.21 |
| 7 | 1.11 | 1.22 |
| 8 | 1.12 | 1.23 |
| 9 | 1.13 | 1.24 |
| 10 | 1.14 | 1.25, |

the entire back of the club head being located on one side of an area defined by a plane which is parallel to the axis of the golf club shaft and tangential to the top of the back of the club head.

2. The correlated set of clubs of claim 1 further comprising for the at least three clubs added weight of density not less than 16 grams per cubic centimeter in the back of the heel area of the club head.

3. The correlated set of clubs of claim 2 wherein the added weight in the heel and toe areas comprises from about 85 to about 95% tungsten.

4. A correlated set of golf club irons comprising at least three irons at least one of which is selected from the group consisting of the 2, 3, and 4 irons, each of which comprises a shaft and a steel club head, the club head of at least three of the irons having heel and toe portions, weighting means for said club head, said weighting means including added weight in the back of the club head in at least the toe area of the club head of a density not less than 16 grams per cubic centimeter, scoring on the face of the club, and said weighting means further including an indentation in the rear of the club head at least a portion of which is behind the scored area, the mass and position of the added weight and the size and position of the indentation being sufficient in combination to provide the club head with a radius of gyration about an axis which is parallel to the axis of the shaft and which passes through the centroid of the club head within about the following limits for the at least three irons:

| IRON | MINIMUM RADIUS OF GYRATION (Inches) | MAXIMUM RADIUS OF GYRATION (Inches) |
|---|---|---|
| 2 | 1.06 | 1.17 |

-continued

| IRON | MINIMUM RADIUS OF GYRATION (Inches) | MAXIMUM RADIUS OF GYRATION (Inches) |
|---|---|---|
| 3 | 1.07 | 1.18 |
| 4 | 1.08 | 1.19 |
| 5 | 1.09 | 1.20 |
| 6 | 1.10 | 1.21 |
| 7 | 1.11 | 1.22 |
| 8 | 1.12 | 1.23 |
| 9 | 1.13 | 1.24 |
| 10 | 1.14 | 1.25. |

the entire back of the club head being located on one side of an area defined by a plane which is parallel to the axis of the golf club shaft and tangential to the top of the back of the club head.

5. The correlated set of golf clubs of claim 4 wherein for each of the at least three clubs the indentation is throughout a substantial portion of the back of the club head behind the scored area of the club head face.

6. The correlated set of clubs of claim 5 wherein there is at least one supporting rib across the indented area of the at least three clubs.

7. The correlated set of golf clubs of claim 6 wherein the center line of each rib essentially bisects the angle formed by the intersection for each club of the lines extending along the top of the back of the club head and the bottom of the back of the indentation.

8. A correlated set of golf club irons comprising the 2 through 9 irons, each club comprising a shaft and a steel club head having heel and toe portions, weighting means for said club head, said weighting means including added weight of density not less than about 16 grams per cubic centimeter inserted into the back of the steel club head at least at the toe area of the club head, and said weighting means further including at least one indentation in the back of the club head between the heel and toe portions, the mass and position of the added weight and the size and position of the indentation being sufficient in combination to provide the club head with a radius of gyration about an axis which is parallel to the axis of the shaft and which passes through the centroid of the club head within about the following limits:

| IRON | MINIMUM RADIUS OF GYRATION (Inches) | MAXIMUM RADIUS OF GYRATION (Inches) |
|---|---|---|
| 2 | 1.06 | 1.17 |
| 3 | 1.07 | 1.18 |
| 4 | 1.08 | 1.19 |
| 5 | 1.09 | 1.20 |
| 6 | 1.10 | 1.21 |
| 7 | 1.11 | 1.22 |
| 8 | 1.12 | 1.23 |
| 9 | 1.13 | 1.24, |

the entire back of the club head being located on one side of an area defined by a plane which is parallel to the axis of the golf club shaft and tangential to the top of the back of the club head.

9. The correlated set of clubs of claim 8 wherein the added weight comprises from about 85 to about 95% tungsten.

10. The correlated set of clubs of claim 8 further comprising added weight of density not less than 16 grams per cubic centimeter in the heel area of each of the club heads.

11. The correlated set of clubs of claim 8 wherein the radius of gyration of each club head is higher for each successive club in numerical order from the 2 iron to the 9 iron.

12. The correlated set of clubs of claim 8 wherein the weight of the club head of the 2 iron is from about 7 to about 9 ounces, the 9 iron from about 9 to about 11 ounces, the weight of each club head from the 3 to the 8 having a weight therebetween, the weight of each successive club head in numerical order being greater than the weight of the club head preceding it in numerical order.

13. A correlated set of golf club irons comprising the 2 through 9 irons, each club comprising a shaft and a steel club head having heel and toe portions, weighting means for said club head, said weighting means including added weight of density not less than about 16 grams per cubic centimeter inserted into the back of the steel club head at least at the toe area of the club head, a scored area on the face of the club head, an indentation in the rear of the club head at least a portion of which is behind the scored area, the mass and position of the added weight and the size and position of the indentation being sufficient in combination to provide the club head with a radius of gyration about an axis which is parallel to the axis of the shaft and which passes through the centroid of the club head within about the following limits:

| IRON | MINIMUM RADIUS OF GYRATION (Inches) | MAXIMUM RADIUS OF GYRATION (Inches) |
|---|---|---|
| 2 | 1.06 | 1.17 |
| 3 | 1.07 | 1.18 |
| 4 | 1.08 | 1.19 |
| 5 | 1.09 | 1.20 |
| 6 | 1.10 | 1.21 |
| 7 | 1.11 | 1.22 |
| 8 | 1.12 | 1.23 |
| 9 | 1.13 | 1.24, |

the entire back of the club head being located on one side of an area defined by a plane which is parallel to the axis of the golf club shaft and tangential to the top of the back of the club head.

14. The correlated set of golf clubs of claim 13 wherein for each of the clubs the indentation is throughout a substantial portion of the back of the club head behind the scored area of the club head face.

15. The correlated set of clubs of claim 14 wherein there is at least one supporting rib across the indented area.

16. The correlated set of golf clubs of claim 15 wherein the center line of each rib essentially bisects the angle formed by the intersection for each club of the lines extending along the top of the back of the club head and the bottom of the back of the indentation.

17. The correlated set of clubs of claim 13 wherein the radius of gyration of each club head is higher for each successive club in numerical order from the 2 iron to the 9 iron.

18. The correlated set of clubs of claim 13 wherein the weight of the club head of the 2 iron is from about 8 to about 9 ounces, the 9 iron from about 10 to about 11 ounces, the weight of each club head from the 3 to the 8 having a weight therebetween, the weight of each successive club head in numerical order being greater than the weight of the club head preceding it in numerical order.

* * * * *